United States Patent [19]

Burchett et al.

[11] Patent Number: 4,845,325

[45] Date of Patent: Jul. 4, 1989

[54] SELF-RETAINING ACTUATOR

[75] Inventors: Robert B. Burchett, Boca Raton; Douglas D. Peebles, Pompano Beach, both of Fla.

[73] Assignee: Motorola, Inc., Schaumburg, Ill.

[21] Appl. No.: 140,446

[22] Filed: Jan. 4, 1988

[51] Int. Cl.[4] ..... H01H 13/06

[52] U.S. Cl. ..... 200/302.2; 200/345

[58] Field of Search ..... 200/302.3, 302.2, 302.1, 200/340, 345, 341

[56] References Cited

U.S. PATENT DOCUMENTS 4,386,254 5/1983 Eberhardt et al. ..... 200/302.2

FOREIGN PATENT DOCUMENTS 1590146 5/1970 Fed. Rep. of Germany ... 200/302.3

2344945 10/1977 France ..... 200/302.2

OTHER PUBLICATIONS

Motorola "STX" Series Service Manual, printed 1986.

*Primary Examiner*—Renee S. Luebke

*Attorney, Agent, or Firm*—Daniel K. Nichols

[57] ABSTRACT

A self-retaining actuator is provided for actuating a switch within a housing. A lever includes fingers which extend through a hole in the housing. Lips on the fingers mount the lever to the housing. A resilient seal is positioned about the fingers and engages the lever and housing about the hole. A resilient actuator extends from the seal between the fingers to actuate the switch when the lever is depressed.

4 Claims, 2 Drawing Sheets

SELF-RETAINING ACTUATOR

BACKGROUND OF THE INVENTION

This invention relates to actuators in general and particularly to an actuator that is self-retaining. It is often necessary to mount an actuator on a housing in order to actuate a device within the housing. One application for such actuators is in conjunction with a push-to-talk (PTT) switch for a portable radio. A switch, such as a popple switch, can be provided on the interior of the radio housing and can be actuated by the depression of a push-to-talk lever mounted on the outside of the housing.

One known approach is to mount an actuator on the housing utilizing an ultrasonically welded cover. A PTT lever mounted on the housing engages the cover to operate the actuator. While the use of an ultrasonically welded cover on the actuator provides a water seal, this approach is both expensive and time consuming in manufacture. It is desirable to provide an actuator assembly that is both easy to manufacture and inexpensive, while providing both a seal and retention of the actuator and lever to the housing.

SUMMARY OF THE INVENTION

This self-retaining actuator includes means for locating and attaching the actuator to the housing and provides a seal about the actuator.

The self-retaining actuator assembly includes a housing having an opening. A lever means includes a plurality of fingers that are received through the opening. Each finger includes hook means that are received by the housing for retaining the lever means to the housing. An actuator means extends through the housing opening between the fingers. A seal means is positioned about the actuator means and engages the lever means and the housing about the opening.

In one aspect of the invention, the actuator means is formed of resiliently flexible material. In another aspect of the invention, the actuator means and the seal means are both integrally formed of resiliently flexible material. In still another aspect of the invention, the housing contains a switch and the actuator means selectively actuates the switch. In still another aspect of the invention, the switch is a push-to-talk switch.

DESCRIPTION OF THE PREFERRED EMBODIMENT

Figure 1:
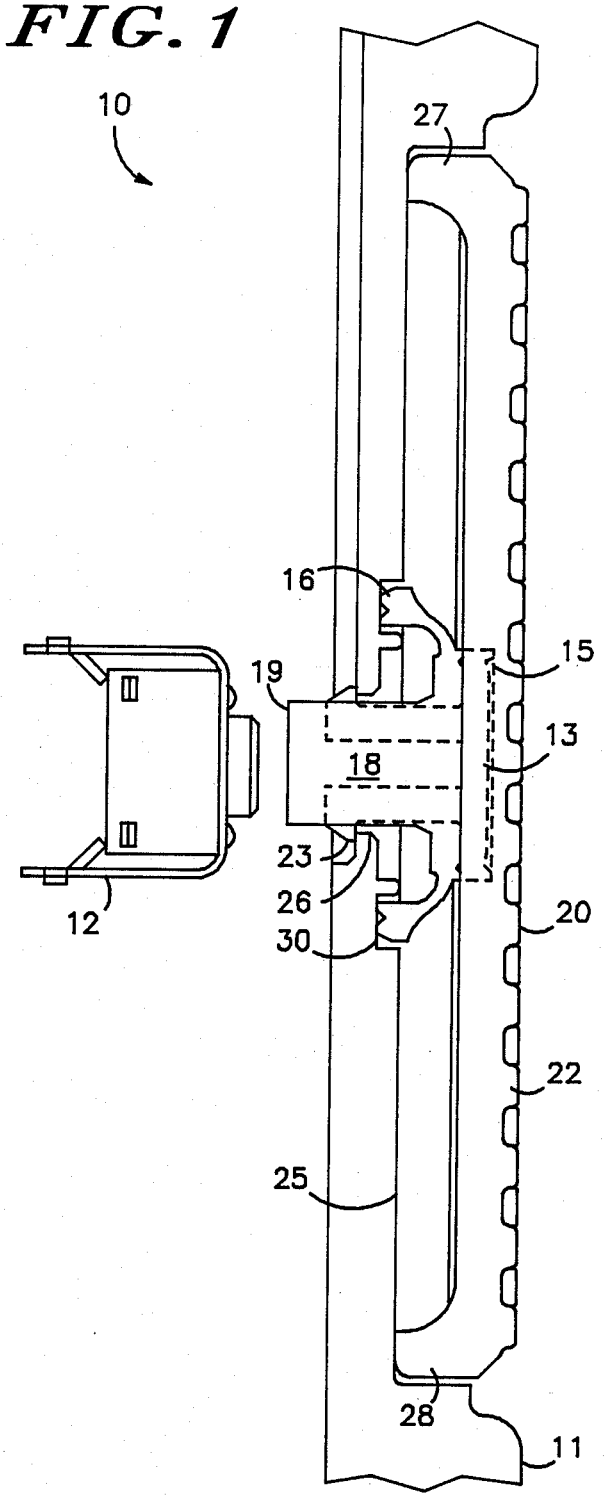
FIG. 1 is a fragmentary front elevational view of an actuator assembly in accordance with the present invention.

Referring now by characters of reference to the drawings and first to FIG. 1, it will be understood that the actuator assembly 10 is carried by a housing 11. In the preferred embodiment, the actuator assembly 10 is utilized to actuate a switch 12 that is located on the interior of the housing 11.

Figure 2:
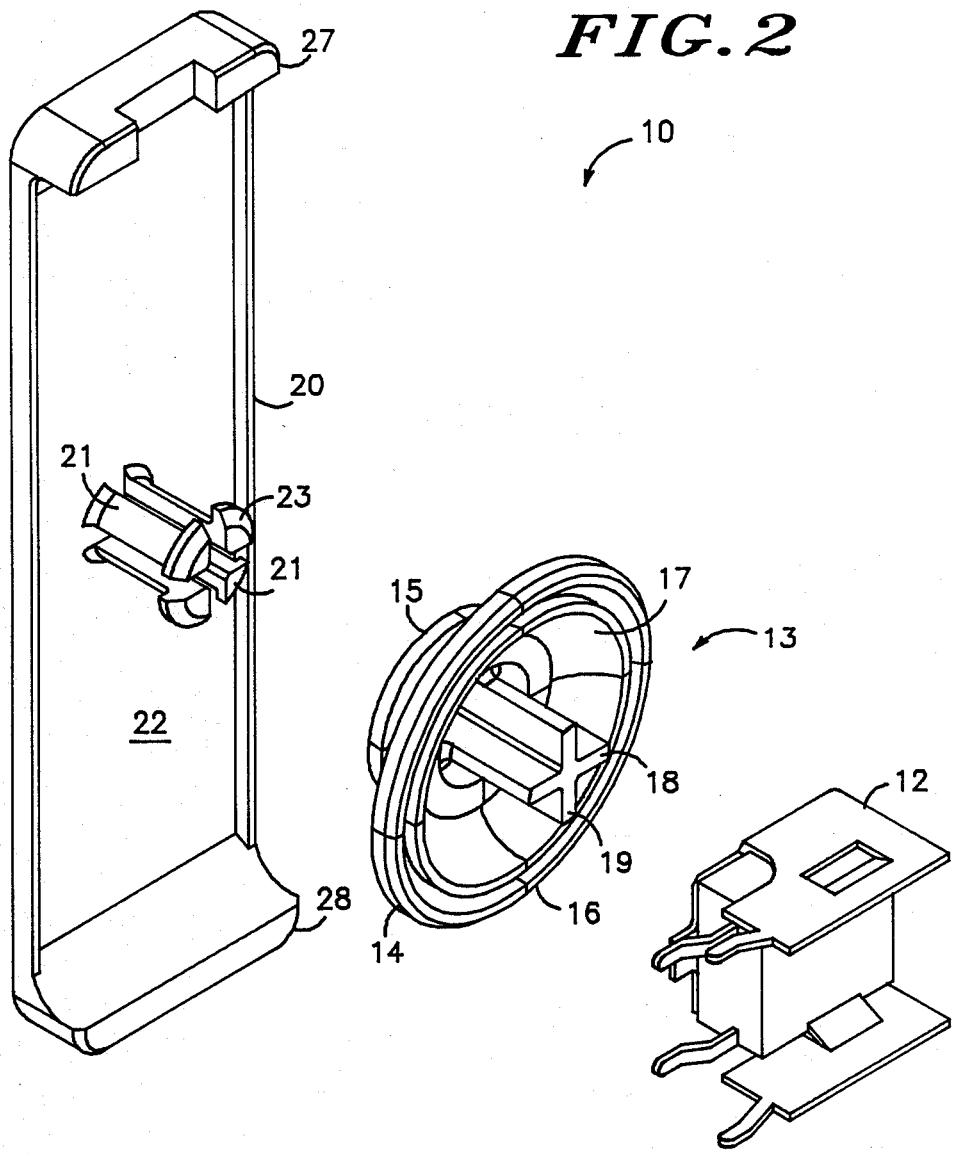
FIG. 2 is an exploded view of the actuator assembly and switch.

Referring now to FIG. 2, it will be seen that the actuator assembly 10 includes an actuator/seal 13. The actuator/seal 13 includes a cup shaped seal 14, comprising seal means, having a smaller diameter seal surface 15 and an opposite larger diameter seal surface 16 interconnected by web 17. Extending from the smaller diameter seal surface 15, through the larger diameter seal surface 16, is an actuator portion 18 comprising actuator means. The actuator portion 18 is formed, in cross-section, in the shape of an X or a cross, the end 19 of which provides an engagement surface for actuating the switch 12. A lever or button 20, constituting lever means, includes a plurality of locating and retaining fingers 21 carried by a longitudinal body 22. In the preferred embodiment there are four fingers 21 which are positioned to receive the actuator portion 18. Each finger 21 includes a lip portion 23 at its end remote from the body 22. The lever 20 is preferably made of resilient plastic material and includes opposed end feet 27 and 28.

In order to assemble the switch actuator assembly 10, the actuator/seal 13 is positioned with its smaller diameter seal surface 15 against the lever body 22 and the actuator portion 18 between the fingers 21. The housing 11, as seen in FIG. 1, includes a depression 25 that is dimensioned to receive the lever 20. A central axial opening or hole 26 through the housing 11 in a depression 25 receives the fingers 21 and actuator portion 18. Pressure applied by pushing against the lever 22 is used to force the fingers 21 to converge against their resilient force and that of the actuator 18. The lips 23 each provide a cam surface for deflecting the fingers 21, and pass through the opening 26. Once the lips 23 have passed through the hole 26, the fingers 21 return to their normal position. The lips 23 engage the inside wall of housing 11 about the opening 26, preventing withdrawal of the fingers 21 from the hole 26. In this position, the larger diameter seal surface 16 of the actuator/seal 13 engages a groove 30 in the exterior wall of the housing 11 within the depression 25. The actuator portion 18 extends into the housing 11 with its end 19 positioned adjacent to the switch 12. The lever feet 27 and 28 engage the housing 11 within the depression 25 to permit bending of the lever 20 when it is pressed.

In order to actuate the switch 12, the lever 20 is pressed toward the housing 11 causing the lever to flex or bend and the cup shaped seal 14 to deform. The actuator end 19 moves toward and into engagement with the switch 12 thereby actuating the switch 12. When the lever 20 is released the resiliency of the lever causes it to return to its original position and the resilient force of the seal 14 and actuator portion 18 draw the actuator end 19 away from the switch 12.

The actuator assembly 10 provides a seal about the opening 26 with the smaller diameter seal surface 15 engaging the lever body 21 and the larger diameter seal surface 16 engaging the housing groove 30. The lips 23 engage the inside wall of the housing 11 to capture the lever 20 and the actuator/seal 13, maintaining them in position. The switch 12, which in the preferred embodiment is mounted on a printed circuit board (not shown) and functions as a PTT switch, is positioned so as to be actuated when the lever 20 is depressed. The actuator/seal 13 of the preferred embodiment is integrally molded of resiliently flexible material such as silicone rubber. In the event of over travel by the actuator portion 18, it will resiliently compress thereby preventing damage to the switch 12.

We claim as our invention:

1. A self-retaining actuator assembly comprising:

a housing having an opening;

a lever means including a plurality of fingers received through said opening, each finger including lip means within the housing for retaining the lever means to the housing;

an actuator means extending through the housing opening between the fingers;

a seal means positioned about the actuator means and engaging the lever means and the housing about the opening, and, the actuator means being formed of resiliently flexible material.

2. A self-retaining actuator assembly comprising:

a housing having an opening;

a lever means including a plurality of fingers received through said opening, each finger including lip means within the housing for retaining the lever means to the housing;

an actuator means extending through the housing opening between the fingers;

a seal means positioned about the actuator means and engaging the lever means and the housing about the opening, and, the actuator means and the seal means being integrally formed of resiliently flexible material.

3. A self-retaining actuator assembly as defined in claim 2, in which:

the housing contains a switch and the actuator means selectively actuates the switch.

4. A switch actuator assembly as defined in claim 3, in which:

said switch is a push-to-talk switch.

* * * * *